US005272821A

United States Patent [19]

Orloff et al.

[11] Patent Number: 5,272,821

[45] Date of Patent: Dec. 28, 1993

[54] METHOD AND APPARATUS FOR DRYING WEB

[75] Inventors: David I. Orloff, Atlanta, Ga.; William J. Lenling, Madison, Wis.

[73] Assignee: Institute of Paper Science and Technology, Inc., Atlanta, Ga.

[21] Appl. No.: 643,524

[22] Filed: Jan. 18, 1991

Related U.S. Application Data

[63] Continuation-in-part of Ser. No. 417,261, Oct. 15, 1989, Pat. No. 5,101,574.

[51] Int. Cl.[5] ..... F26B 13/28

[52] U.S. Cl. ..... 34/110; 162/202; 162/374

[58] Field of Search ..... 34/110, 41, 111, 16; 162/202, 211, 217, 352, 359, 374

[56] References Cited

U.S. PATENT DOCUMENTS 4,874,469 10/1989 Pulkowski et al. ..... 34/111 X 4,888,095 12/1989 Gulya et al. ..... 34/110 X

*Primary Examiner*—Henry A. Bennet

*Attorney, Agent, or Firm*—Fitch, Even, Tabin & Flannery

[57] ABSTRACT

The present invention is directed to a method and apparatus for drying a web of paper utilizing impulse drying techniques. In the method of the invention for drying a paper web, the paper web is transported through a pair of rolls wherein at least one of the rolls has been heated to an elevated temperature. The heated roll is provided with a surface having a low K value of less than about 3000 $w\sqrt{s}/m^2c$ and having a low porosity. The surface material of the roll is preferably prepared from a material selected from the group consisting of ceramics, polymers, glass, inorganic plastics, composite materials and cermets. The heated roll may be constructed entirely from the material having a low K value or the roll may be formed from metal, such as steel or aluminum, or other suitable material which is provided with a surface layer of a material having a low K value.

8 Claims, 5 Drawing Sheets

METHOD AND APPARATUS FOR DRYING WEB

RELATED APPLICATIONS

This application is a continuation-in-part of application Ser. No. 417,261 filed Oct. 15, 1989 now U.S. Pat. No. 5,101,574.

FIELD OF THE INVENTION

The present invention relates generally to a method and apparatus for drying a wet paper web as it passes through the press nip of a pair of rolls in which one of the pair of rolls is heated to a high temperature. More particularly, the present invention relates to impulse drying of a wet paper web through use of a heated roll having a surface with a low value of less than about 3000 for the quantity $K=\sqrt{\rho c\lambda}$.

BACKGROUND OF THE INVENTION

Impulse drying occurs when a wet paper web passes through the press nip of a pair of rolls in which one of the rolls is heated to a high temperature. A steam layer adjacent to the heated surface grows and displaces water from the sheet in a more efficient manner than conventional evaporative drying. It is projected that wide commercialization of impulse drying would result in very large industry wide energy savings.

Impulse drying is described in U.S. Pat. No. 4,324,613 to Wahren. Impulse drying is drying by means of heating one of a pair of rolls to a high temperature prior to passing a paper web between a pair of rolls. In the method of the Wahren patent, the surface of one of the rolls is heated to a high temperature by an external heat source immediately prior to passing the paper web between the heated roll and another roll. The Wahren patent describes the use of solid rolls having at least a surface layer having high thermal conductivity and high thermal diffusivity, such as copper or cast iron, for use as the heated roll.

The Wahren patent teaches that, in normal cases, a major part of the drying must take place in the press nip and final drying takes place after the nip. It is concluded the conductivity of the material of which the heating roll is made must be high so as not to dry at roll surface temperatures higher than necessary. A high conductivity means that the heat can be conducted to a greater depth in the roll and even extracted from a greater depth, which in itself means that a lower roll temperature can be used.

According to the Wahren patent, the choice of material is limited by the risk of thermal fatigue and, in this respect, at least the surface layer of the roll should be made of a material for which the quantity $$\frac{\sigma\mu(1-\upsilon)\sqrt{\rho c\lambda}}{Ea_c}$$

has a high value, desirably at least $0.6\times10^6$, where $\sigma\mu$ is the fatigue strength, $\upsilon$ is Poisson's ratio, $\rho$ is the density, c is the specific thermal capacity, $\lambda$ is the thermal conductivity, E is the modulus of elasticity, and $a_c$ is the coefficient of thermal expansion for the material. Copper alloys have the highest values, approximately $1.3\times10^6$. However, they have rather poor resistance to wear and are not suitable for doctoring. Other suitable materials are duralumin ($0.7\times10^6$), cast iron ($0.67\times10^6-0.85\times10^6$), steel ($0.8\times10^6$) and nickel (approximately $0.8\times10^6-0.9\times10^6$).

Thus, the Wahren patent teaches the use of high conductivity surfaces, such as metal surfaces on the heated roll used in impulse drying. The Wahren patent does not teach or recognize the desirability of using heated roll surfaces made from a material with a low value of the quantity $K=\sqrt{\rho c\lambda}$ such as are used in the heated roll of the present invention.

In addition to the impact on energy consumption, impulse drying also has an effect on paper sheet structure and properties. Surface fiber conformability and interfiber bonding are enhanced by transient contact with the hot surface of the roll. As the impulse drying process is usually terminated before the sheet is completely dried, internal flash evaporation results in a distinctive density profile through the sheet that is characterized by dense outer layers and a bulky midlayer. For many paper grades, this translates into improved physical properties. The persistent problem with the use of impulse drying, however, is that flash evaporation can result in delamination of the paper sheet. This is particularly a problem with heavy weight grades of paper. This has been a major constraint as to the commercialization of impulse drying.

It has been reported, Crouse, J. W., et al., "Delamination: A Stumbling Block to Implementation of Impulse Drying Technology for Liner Board", Tappi Engineering Conference, Atlanta, Ga., Sep. 13, 1989, that various degrees of delamination were experienced with liner board dried at press roll surface temperatures above 150° C. (300° F.). When delamination was avoided by operating at the lowest limit, water removal efficiencies were not significantly different than those obtained by conventional drying. It is concluded in this report that to realize the potential of impulse drying, it would be necessary to alleviate delamination.

In laboratory scale simulations, Lavery, H. P. "High Intensity Drying Processes-Impulse Drying Report", Three DOE/CE/407383-T3, February, 1988, it was found that increased pulp refining encouraged delamination and it was postulated that very thick or highly refined sheets exhibit greater resistance to the flow of vapor than thin or coarse paper webs. Hence, if the flow resistance of the web became so large that high pressure steam could not escape, the sheet may not be strong enough to sustain the pressurized vapor and delamination would occur.

The effect of hot surface materials on delamination has been investigated, Santkuyl, R. J., "The Effect of Hot Surface Material on Delamination in Impulse Drying", Master's Program, Institute of Paper Science and Technology, March, 1989. Using an electrohydraulic impulse drying simulator, carbon steel, aluminum and sintered porous stainless steel platens were tested in terms of their ability to dewater and suppress delamination. A felt back-up pad was used in the simulations. It was observed that a difference in K value between steel (K value of 15,000 $w\sqrt{s}/m^2c$) and aluminum (K value of 22,000 $w\sqrt{s}/m^2c$) had no affect on dewatering capacity or the propensity for paper sheets to delaminate. Porous stainless steel (K value of 3000 $w\sqrt{s}/m^2c$) platens provided completely suppressed delamination, although also providing considerable lower dewatering capacity. For porous materials, such as sintered porous stainless steel, a mass balance on the paper sheet showed that a large fraction of the water was removed as vapor and a much smaller fraction was displaced as liquid water into the backup felt. It was concluded that the porous platens do not operate by an impulse drying mechanism. Instead, steam formation and venting at the hot platen-vapor interface augmented by hot pressing were considered to be responsible for water removal. As a result of venting, measured temperatures within the vapor sheets never exceeded 100° C. (212° F.) and flash evaporation could not occur.

U.S. Pat. No. 3,296,710 to Krikorian is directed to the use of a porous absorbent layer on a roll to take up the water from the web. The water which is taken up in the pores of the porous roll is later evaporated by means of heating the porous layer. The use of a porous material is substantially different than the use of a solid material. The Krikorian patent is not related to the use of impulse drying. A porous material is not suitable for use as a roll for impulse drying since the porous material absorbs the moisture from paper in the nip of the rolls and such moisture is subsequently evaporated from the pores of the porous material.

Accordingly, it is a principal object of the present invention to provide a roll surface material which is suitable for use in impulse drying over a broad range of temperatures and nip residence times but wherein delamination of the paper web is prevented.

It is another object of the present invention to provide a roll surface material that can be heated for impulse drying and can attain efficiencies comparable to that of solid cast iron, copper or steel rolls but which do not result in delamination of the paper web under high energy transfer conditions.

SUMMARY OF THE INVENTION

Figure 1:
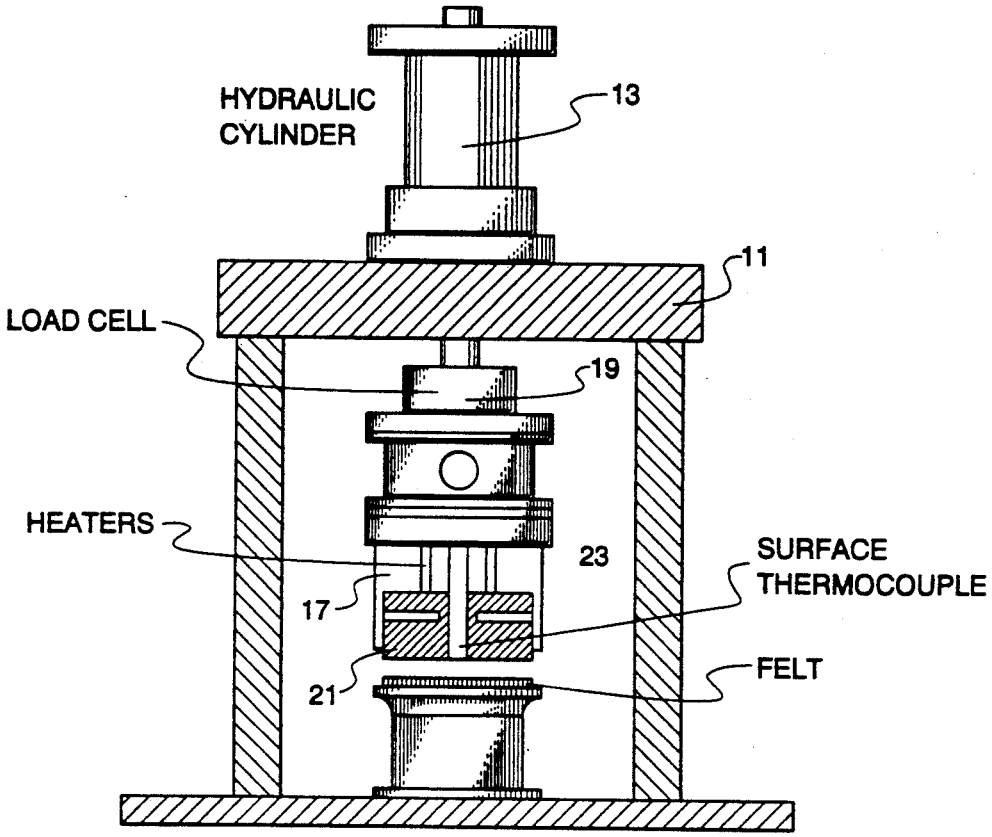
FIG. 1 is a schematic diagram of an electrohydraulic press that is designed to simulate impulse drying.

The present invention is directed generally to a method and apparatus for drying a web of paper utilizing impulse drying techniques. In the method of the invention for drying a paper web, the paper web is transported through a pair of rolls wherein at least one of the rolls has been heated to an elevated temperature. The heated roll is provided with a surface having a low K value of less than about 3000 $w\sqrt{s}/m^2c$ and having a relatively low porosity. The surface material of the roll is preferably prepared from a material selected from the group consisting of ceramics, polymers, glass, inorganic plastics, composite materials and cermets. The heated roll may be constructed entirely from the material having a low K value and low porosity or the roll may be formed from steel or other suitable material which is provided with a surface layer of a material having a low K value and low porosity.

DETAILED DESCRIPTION OF THE INVENTION

The present invention is directed to the discovery that the probability of delamination during impulse drying can be substantially reduced by reducing the energy released during flash evaporation. In accordance with the present invention, the K value of the surface of the heated roll is reduced to such an extent that the energy transferred to the paper web in the later stages of the impulse drying process is substantially reduced, thereby reducing the energy available for flash evaporation. It should be understood that this is substantially different from the use of a porous platen which prevents the occurrence of flash evaporation in that, in accordance with the present invention, the strength of the flash evaporation is reduced rather than preventing its occurrence.

In accordance with the invention, a roll is provided for use in impulse drying which has a surface having a low K value of less than about 2000 $w\sqrt{s}/m^2c$ and having a low porosity. The surface material of the roll may be coated onto a metal substrate, such as a steel roll, or the roll may be constructed of the material having the low K value. Preferably, the K value of the surface of the roll is from about 100 $w\sqrt{s}/m^2c$ to about 3000 $w\sqrt{s}/m^2c$. The K value is the quantity $\sqrt{\rho c\lambda}$, where $\lambda$ is the thermal conductivity, $\rho$ is the density and c is the specific heat, which reduces to $w\sqrt{s}/m^2c$ where w is watts, s is seconds, m is meters and c is degrees Centigrade.

Low porosity is required on the surface of the heated roll to prevent absorption of water in the roll surface as the paper web passes between the heated roll and the unheated roll. In accordance with the present invention, the surface of the heated roll used for impulse drying should have a porosity of less than about 10% by volume.

Suitable materials having a low K value and low porosity for providing the roll surface of the invention may be selected from the group consisting of ceramic, polymers, inorganic plastic, glass, composite materials and cermets.

Ceramics are non-metallic inorganic materials containing high proportions of silicon, silicon oxide, silicates, aluminum oxide, magnesium oxide, zirconium oxide and other metal oxides. One group of ceramics is prepared from mixtures of powders of clay, flint and feldspar. Triaxial ceramics are those prepared from the foregoing three components with occasional secondary fluxes, such as lime and magnesia. Non-triaxial ceramics contain other components such as talc, bone ash, pyrophyllite and alumina. One suitable type of ceramics are those having a high proportion of alumina or zirconia of above about 30%. Ceramics are formed by preparing a mixture of the ceramic powder with various amounts of water and thereafter forming the ceramic powder by slip casting, jiggering, drain casting, extrusion or pressing. Thereafter, the form is subjected to one or more heat processes to sinter the powder and form the solid ceramic. Ceramics can also be applied to a suitable substrate, such as a steel or aluminum roll, by a suitable method such as by plasma spraying. The solid ceramic surface has a porosity of less than about 10% by volume and preferably has a porosity of from about 1% to about 7% by volume.

Any suitable polymer can be used for the surface material of the roll of the invention which has a melting point in excess of 200° C. (392° F.). Suitable polymers can be selected by reference to a table of structural properties, such as that contained in the Encyclopedia of Modern Plastics, McGraw-Hill, Inc., mid-October, 1988 Issue, Vol. 65, No. 11, pp. 576–619. Representative polymeric products which are suitable for the surface material of the present invention include polyamides, polyacrylonitrile, polyester, fluoroplastics, such as polyetetrafluoroethylene, polychlorotrifluoroethylene and fluorinated ethylene propylene, melamineformaldehyde, phenolics, such as melaminephenolic, polyesters, polyimides and sulfone polymers.

Any common glass, including ceramic glasses (Pyroceramps), can be used for the surface material of the roll of the invention. Common glass is essentially a sodium calcium silicate in composition. Potassium, barium, zinc, lead, alumina and boron are also often used in various amounts to provide particular properties. The ceramic glasses are produced from irradiated glass by heating them several hundred degrees above the temperature necessary for the development of opacity or color. Ceramic glasses have greater hardness and strength than common glass.

Suitable inorganic plastics include glass bonded mica, phosphol-asbestos compounds and calcium alumina-silicate compounds.

Cermets are a group of materials consisting of an intimate mixture of ceramic and metallic components. Cermets are fabricated by mixing finely divided components in the form of powders or fibers, compacting the components under pressure and sintering the compact to produce a material with physical properties not found solely in either of the components. Cermets can also be fabricated by internal oxidation of dilute solutions of a base metal and a more noble metal. When heated under oxidizing conditions, the oxygen diffuses into the alloy to form a base metal oxide in a matrix of the more noble material. Ceramic components may be metallic oxides, carbides, borides, silicides, nitrides or mixtures of these compounds. The metallic components include a wide variety of metals, such as aluminum, beryllium, copper, chromium, iron, silicon, molybdenum and nickel. Cermets can be applied to substrates by plasma spraying.

Cermets are one form of composite material. Other composite materials useful as the surface material on the roll of the present invention are those which are a matrix of a fiber or flake embedded in a suitable resin. The most commonly known form of composite material is fiberglass, which is a matrix of a glass fiber embedded in a polyester or epoxy resin. Other suitable fibers include those of boron and carbon.

The surface layer of the roll may comprise several layers for enhanced performance. In this connection, high porosity ceramics having a porosity of greater than about 10% by volume have a lower K value than corresponding low porosity ceramics, having a porosity of less than about 10% by volume. High porosity ceramics, however, cannot be used as the surface layer for a roll intended for use in impulse drying, since such high porosity ceramics absorb moisture, as taught by U.S. Pat. No. 3,296,710 to Krikorian. In accordance with one embodiment of the present invention, a high porosity ceramic is used as an intermediate layer for its low K value in combination with an outer layer of a low porosity ceramic which is used for its relatively low K value and resistance to moisture absorption.

In this embodiment, a metallic coating may first be deposited directly onto a metal roll surface. Suitable metals for this coating are nickel alloys and molybdenum. The metal layer is optional but the metal layer enhances the adhesion of a high porosity ceramic coating to the roll and helps prevent corrosion of the roll. The thickness of the metal layer should be greater than 0.01 mm, and is preferably in the range of from about 0.01 mm to about 0.20 mm.

A high porosity intermediate ceramic coating is formed over the metallic layer or directly on the roll if a first metallic layer is not used. Suitable ceramics for this intermediate ceramic layer include silicon oxide, titanium oxide, aluminum oxide and zirconium oxide. The thickness of this intermediate layer should be greater than 0.1 mm, and is preferably in the range of from about 0.1 mm to about 0.5 mm. The porosity should be greater than 10% by volume and is preferably in the range of from about 15% to about 90% by volume.

A third layer of a low porosity ceramic coating is then deposited over the intermediate porous ceramic coating. The third ceramic coating may be the same ceramic material as the intermediate porous ceramic material or may be different. Preferably, the third dense ceramic layer is zirconium oxide or partially or fully stabilized zirconium oxide. The porosity of the third dense ceramic layer is less than 10% by volume and is preferably in the range of from about 1% to about 7%. The third dense ceramic layer is smoothed by any suitable means, such as grinding.

The thickness of the outer low porosity ceramic layer is an important consideration to obtain optimum performance. The outer low porosity ceramic layer should be as thin as possible so that the physical properties of the outer low porosity ceramic layer do not mask the low K value physical properties of the high porosity intermediate ceramic layer. In practical manufacturing terms, the outer low porosity ceramic layer cannot be made much thinner than about 0.02 mm. The maximum thickness of the outer low porosity ceramic layer should not be greater than about 0.10 mm to prevent such masking. Accordingly, the thickness after grinding should be less than about 0.10 mm, and is preferably in the range of from about 0.02 mm to about 0.10 mm. A high temperature hydrocarbon polymer sealant/release agent may be applied to the outer low porosity ceramic layer to enhance paper release and to seal any external pores in the outer ceramic layer.

The three coatings, i.e., the first metallic coating, the second high porosity ceramic coating and the third low porosity ceramic coating may be applied by any suitable method, such as by plasma spraying. Plasma spraying is a well known technique for applying coatings of metals and ceramics. Plasma spraying is described in U.S. Pat. No. 4,626,476 to Londry.

In the method of the present invention, a pair of rolls is used through which a paper web is transported. The surface of one of the rolls is heated to a temperature of from about 200° C. to about 500° C. The heated roll has a surface of a low porosity material having a low K value of less than about 2000 $w\sqrt{s}/m^2c$. The other roll is formed of a suitable material, such as steel or aluminum. In one embodiment, a web of a resilient material, such as felt, is interposed between the unheated roll and the paper web as it passes through the roll nip. In the practice of the method, the two rolls are urged together to provide a compressive force on the paper web as it is transported through the rolls. The residence time can be from about 10 to about 200 ms, preferably from about 20 to about 100 ms.

At the residence times and temperatures useful in the present invention and using a surface material having a K value of less than about 3000 $w\sqrt{s}/m^2c$. The total energy transferred to the paper web as it is transported through the rolls is from about 20 to about 50 $kj/m^2$.

The method of the present invention is useful for the impulse drying of paper webs having an initial moisture level of from about 50% to about 70%. The moisture level of the paper web after being subjected to impulse drying in accordance with the invention will be in the range of from about 40% to about 60%. All percentages used herein are by weight, unless otherwise specified.

The following examples further illustrate various features of the invention, but are intended to in no way limit the scope of the invention which is defined in the appended claims.

EXAMPLE 1

Laboratory scale impulse drying simulations were carried out utilizing the apparatus depicted in FIG. 1. The apparatus includes a frame 11 on which is mounted a hydraulic cylinder 13. The piston 15 of the hydraulic cylinder 13 actuates a heating head 17 through a load cell 19. A heating platen 21 is disposed at the lower extremity of the heating head 17. Heaters 23 are disposed within the heating head 17 for heating the platen 21. A thermocouple 25 is disposed in the heating head for measuring the surface temperature of the platen surface 21. A stand 27 holds a felt pad 29 against which the heating head is actuated by the hydraulic cylinder 13. In the following impulse drying simulations, the heating platen was either steel or a ceramic material. The ceramic material was a Na, K, Al, Ba silicates used as binding agents for mica to form a vacuum tight, glass based ceramic. The ceramic material had a K value of 1600 $w\sqrt{s}/m^2c$. The ceramic is manufactured by Cotronics Corporation of Brooklyn, N.Y. and identified as Type #914.

Figure 2:
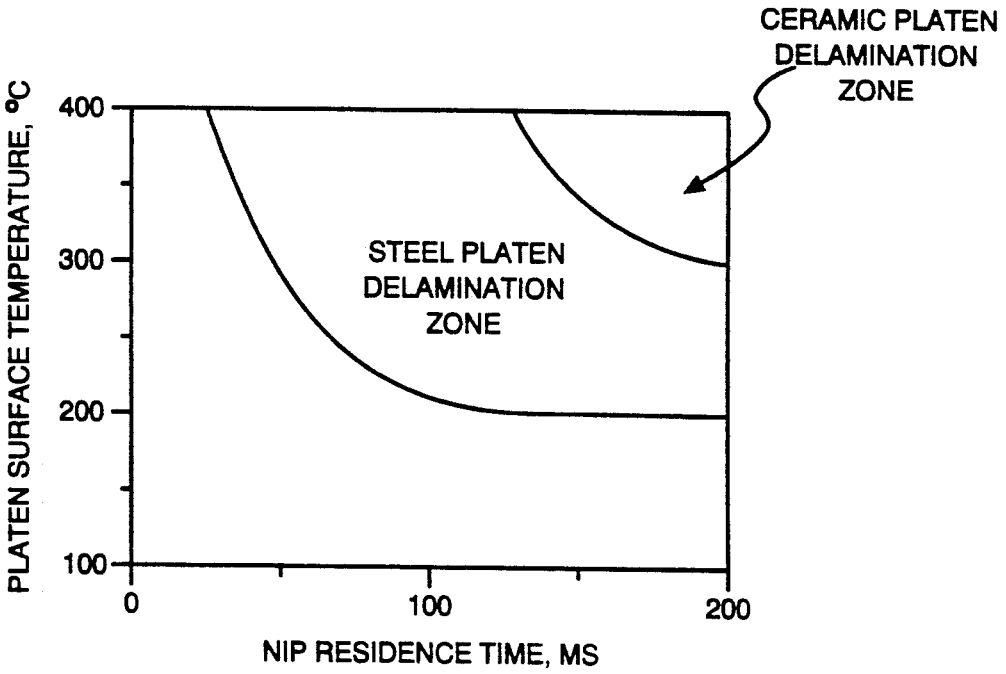
FIG. 2 is a plot of residence time versus the platen surface temperature.

Paper hand sheets having 70 percent moisture were prepared and a series of simulations of impulse drying were conducted wherein the hydraulic cylinder was used to dry the hand sheets by impulse drying at various times, representing nip residence times, and various temperatures at a constant compression of 3MPa. The plot of FIG. 2 depicting lamination zones as a function of residence time and temperature was prepared utilizing a series of impulse drying simulations. As can be seen in FIG. 2, the ceramic platen 21 provided significantly improved delamination properties as compared to a chrome plated steel platen which was also utilized in a series of simulations. As can be seen in FIG. 2, any residence time of up to about 125 milliseconds can be used at any surface temperature up to 400° C.

Figure 3:
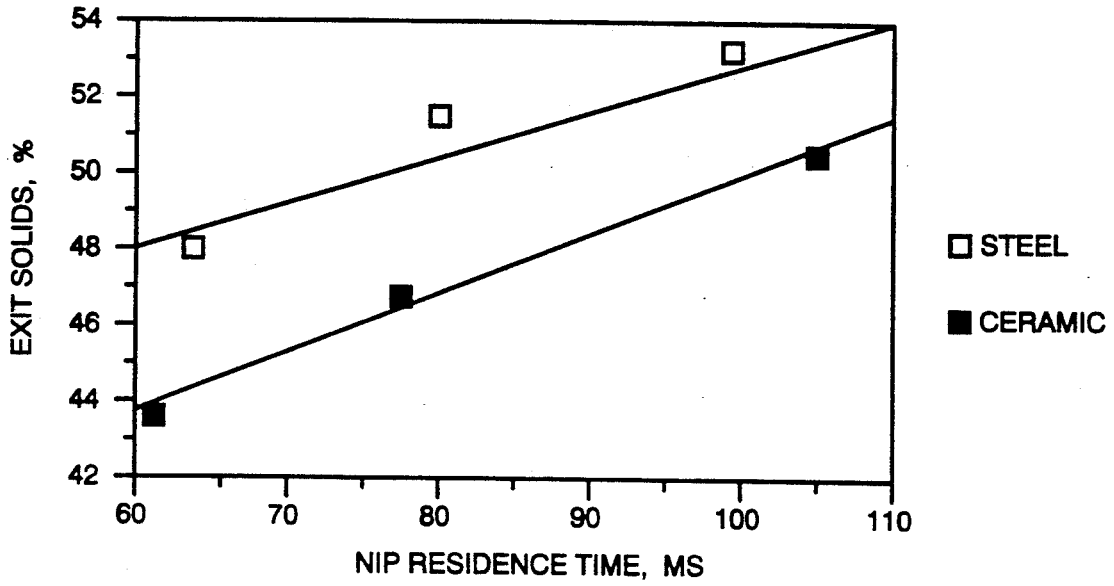
FIG. 3 is a plot of the solids remaining after impulse drying at various nip residence times for steel and ceramic platens.

Hand sheets which were subjected to impulse drying simulation were tested for solids content after the impulse drying simulation. These impulse drying simulations were conducted at a temperature of 260° C. and a compression of 3MPa. The plot of FIG. 3 was prepared utilizing the information obtained from this testing. As can be seen from FIG. 3, a somewhat smaller quantity of water was removed utilizing the ceramic platen as compared to the chrome plated steel platen. The amount of water removed, however, was acceptable for commercial operations.

Figure 4:
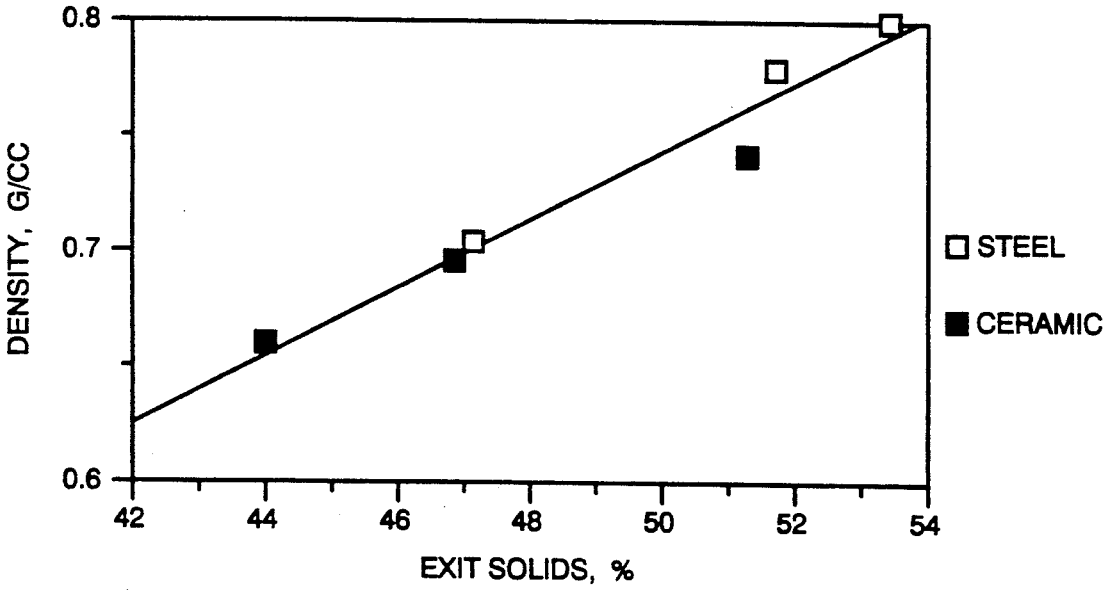
FIG. 4 is a plot of density at various exit solids for steel and ceramic platens.
Figure 5:
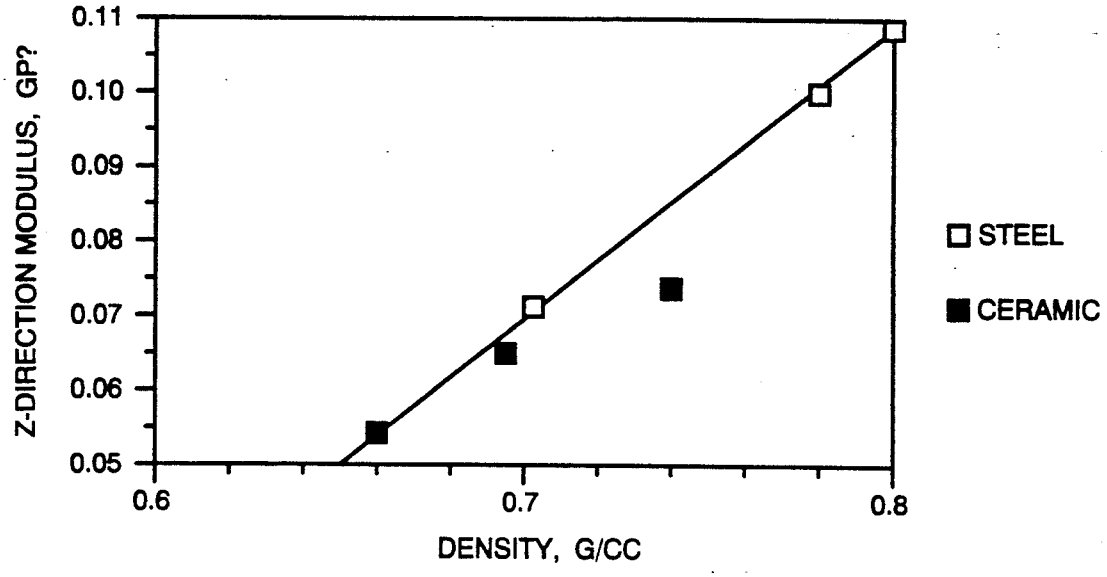
FIG. 5 is a plot of Z-direction modulus versus density for steel and ceramic platens.

The density and Z-direction modulus of the hand sheets subjected to impulse drying simulation were also measured to prepare the plots set forth in FIG. 4 and FIG. 5. These impulse drying simulations were conducted at a temperature of 260° C. and a compression of 3MPa. As can be seen by an examination of FIG. 4 and FIG. 5, the use of a ceramic platen produced densities and Z-direction modulus which were substantially similar to the use of a chrome plated steel platen.

Figure 6:
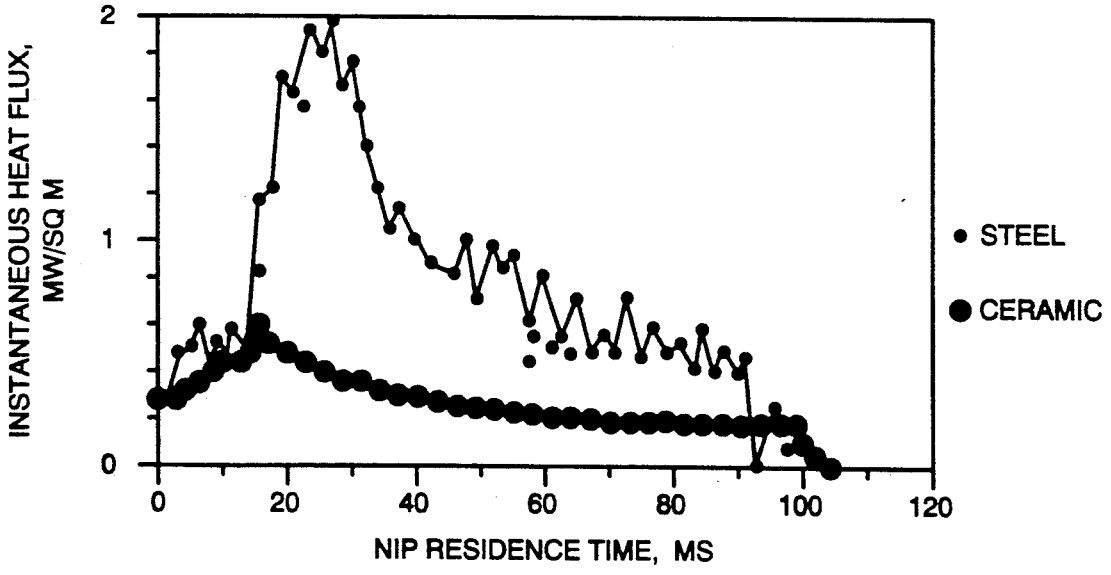
FIG. 6 is a plot of instantaneous heat flux versus residence time for steel and ceramic platens.

A further series of impulse drying simulations were performed on a series of hand sheets having a moisture of 70 percent. These impulse drying simulations were conducted at a temperature of 260° C. and a compression of 3MPa. The instantaneous heat flux of the series of impulse drying simulations was determined and was used to prepare the plot set forth in FIG. 6. As can be seen from FIG. 6, the instantaneous heat flux of the ceramic platen resulted in substantially reduced instantaneous heat flux. While not wishing to be bound by any theory, it is believed that the reduction of the instantaneous heat flux is a substantial contributor to the improved delamination results obtained utilizing the ceramic platen.

Figure 7:
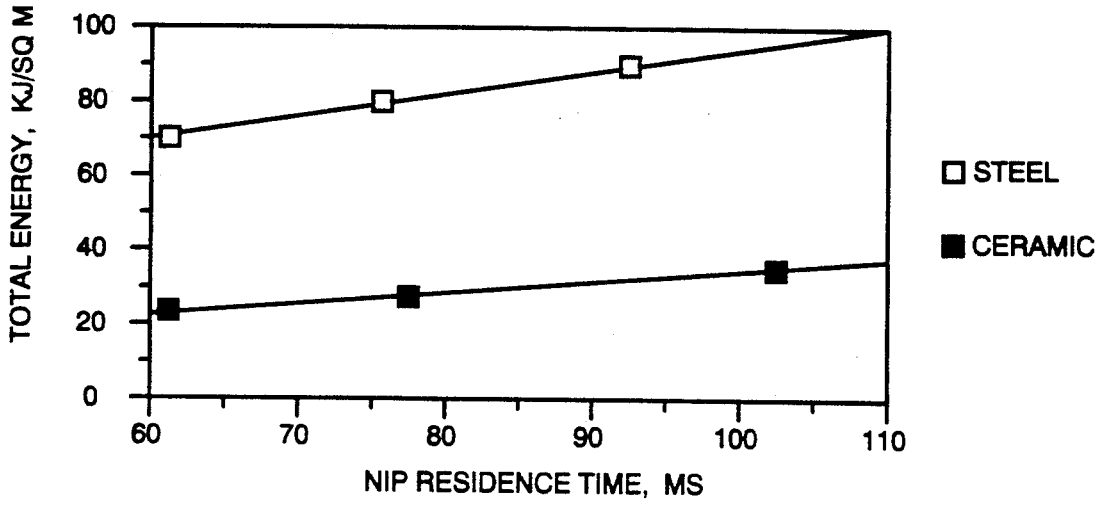
FIG. 7 is a plot of total energy versus nip residence time for steel and ceramic platens.
Figure 8:
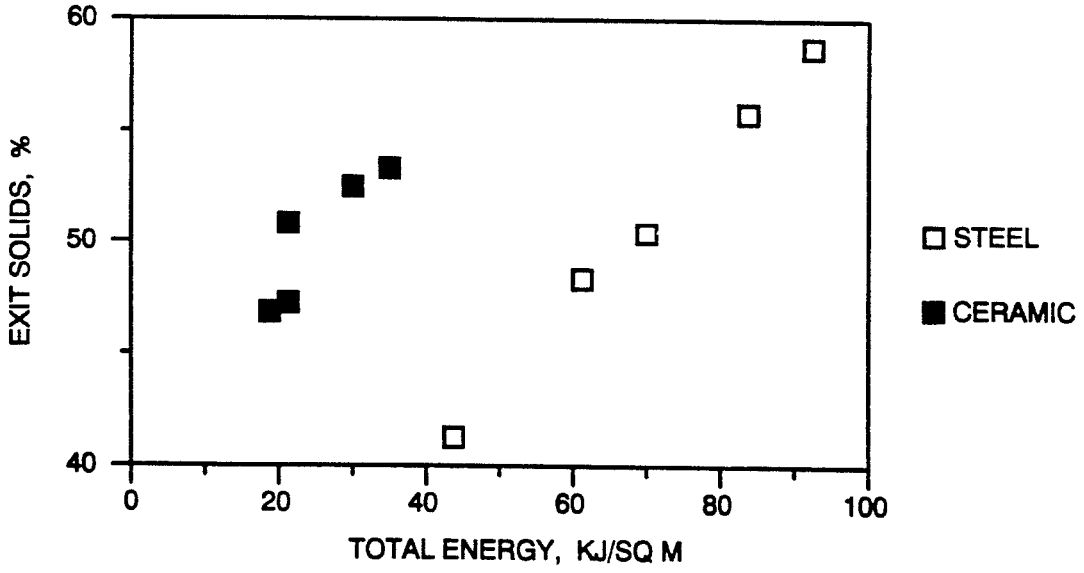
FIG. 8 is a plot of exit solids versus total energy for steel and ceramic platens.
Figure 9:
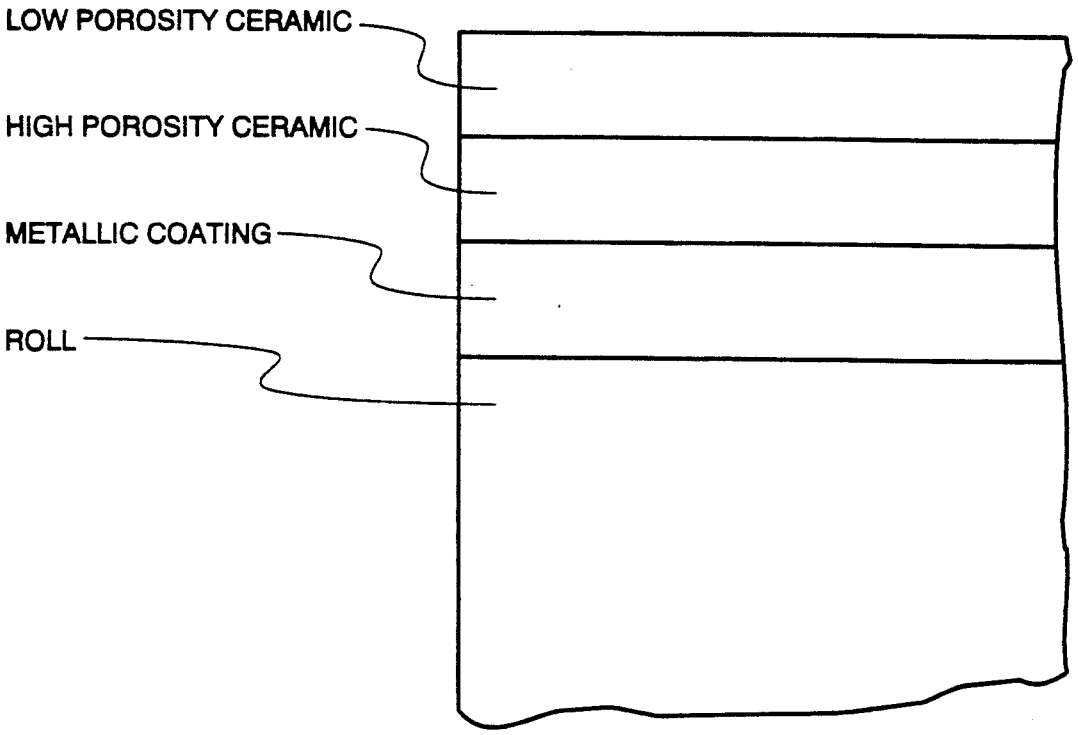
FIG. 9 is a cross-sectional view partially broken away showing the various layers of the roll of the present invention.

A further series of hand sheets having a moisture content of 70% were subjected to simulated impulse heat drying to determine the energy transferred at various residence times. The exit solids of each hand sheet was also determined. These impulse drying simulations were conducted at a temperature of 260° C. and a compression of 3MPa. The data obtained from this series of impulse heat simulations was used to prepare the plots set forth in FIGS. 7 and 8. As can be seen in FIG. 7, the total energy transferred by the ceramic platen was substantially less than the total energy transferred by the chrome steel plated platen. An examination of FIG. 8, however, shows that the total energy transferred by the ceramic platen is more efficient in reducing the solids content of the paper subjected to impulse drying. From the foregoing, it is readily apparent that the improved heating roll of the present invention having a heating surface with a K value less than 1000 $w\sqrt{s}/m^2c$ provides a substantial improvement in impulse drying with respect to energy transfer and lessened probability of delamination.

EXAMPLE 2

A three layer coating was deposited onto a test platen to simulate impulse drying on the laboratory scale. The platen consisted of a 0.11 mm nickel chromium bond coat layer plasma sprayed onto a roughened metal platen. A 0.3 mm 15% porosity by volume zirconium oxide—8% yttrium oxide layer was then plasma sprayed onto the bond coat. This high porosity ceramic layer had a K value of 1700 $w\sqrt{s}/m^2c$. Then a 7% porosity by volume zirconium oxide-8% yttrium oxide layer was plasma sprayed over the second layer. This low porosity ceramic layer had a K value of 2700 $w\sqrt{s}/m^2c$. The platen was then ground so that the third dense ceramic layer had a thickness of 0.05 mm. The relatively thick porous inner layer provides low thermal mass while the thin dense outer layer provides small surface pores which are easily sealed with a high temperature polymeric sealant/release agent such as Frekote B-15 or Frekote 700 NC made by the Dexter Corp.

Various aspects of the invention have been described with particularity; however, numerous variations and modifications will be readily apparent to one skilled in the art.

What is claimed is:

1. A roll suitable for use as the heated roll utilized in impulse drying, said roll having a surface with a low K value of less than about 3000 $\sqrt{s}/m^2c$ and having low porosity of less than about 10% by volume, said roll having a first metallic coating applied to said roll, a second high porosity ceramic coating applied to said first metallic coating and a third low porosity ceramic coating applied to said porous ceramic coating.

2. A roll in accordance with claim 1 wherein the thickness of said first metallic coating is from about 0.1 mm to about 0.20 mm.

3. A roll in accordance with claim 1 wherein the porosity of said second ceramic coating is from about 15% to about 90% by volume.

4. A roll in accordance with claim 1 wherein the thickness of said second porous ceramic layer is from about 0.1 mm to about 0.5 mm.

5. A roll in accordance with claim 1 wherein the thickness of said third dense ceramic coating is from about 0.02 mm to about 0.10 mm.

6. A roll in accordance with claim 1 wherein the porosity of said third ceramic coating is from about 1% to about 7% by volume.

7. A roll in accordance with claim 1 wherein said high porosity ceramic coating is applied directly to said metal roll.

8. A roll in accordance with claim 1 wherein the ceramic used for said high porosity ceramic coating and for said low porosity ceramic coating is selected from the group consisting of zirconium oxide, silicon oxide, titanium oxide, aluminum oxide and mixtures thereof.

* * * * *